US008347939B2

(12) United States Patent
Brabeck et al.

(10) Patent No.: US 8,347,939 B2
(45) Date of Patent: Jan. 8, 2013

(54) CORROSION RESISTANT INTRUDER SCREEN

(75) Inventors: Steven Brabeck, Ormeau (AU); Peter Bouma, Ormeau (AU)

(73) Assignee: IPH Internationanl Pty. Ltd, Queensland (AU)

( * ) Notice: Subject to any disclaimer, the term of this patent is extended or adjusted under 35 U.S.C. 154(b) by 0 days.

(21) Appl. No.: 13/001,607

(22) PCT Filed: Jun. 30, 2009

(86) PCT No.: PCT/AU2009/000844

§ 371 (c)(1),
(2), (4) Date: Dec. 27, 2010

(87) PCT Pub. No.: WO2010/000023

PCT Pub. Date: Jan. 7, 2010

(65) Prior Publication Data

US 2011/0114268 A1 May 19, 2011

(30) Foreign Application Priority Data

Jun. 30, 2008 (AU) ..... 2008903317

(51) Int. Cl.
*A47B 5/00* (2006.01)

(52) U.S. Cl. ..... 160/380; 160/371

(58) Field of Classification Search ..... 160/371, 160/380, 382, 383, 391, 395, 392, 369, 399, 160/402, 384, 394, 368.1, 403; 52/656.5; 38/102.91; 24/460, 461, 462
See application file for complete search history.

(56) References Cited

U.S. PATENT DOCUMENTS 1,758,720 A * 5/1930 Sodergren ..... 160/392
2,255,581 A * 9/1941 Ewing ..... 160/392
(Continued)

FOREIGN PATENT DOCUMENTS

AU 2005218021 A1 4/2006
(Continued)

OTHER PUBLICATIONS

International Search Report dated Jul. 14, 2009 (PCT/AU2009/000844).

*Primary Examiner* — Katherine W Mitchell
*Assistant Examiner* — Johnnie A Shablack
(74) *Attorney, Agent, or Firm* — Edwards Wildman Palmer LLP; Howard M. Gitten

(57) ABSTRACT

A corrosion resistant intruder screen has a frame including elongate frame members (3) with a mesh (4) clamped to frame members (3). The frame members (3) each have a first holding channel (50) formed therein and a clamping portion (6) spaced from the first holding channel (50). Clamping members (7) co-act with fastening means (8) to clamp the mesh (4) between the clamping members (7) and the clamping portions (6) with leveraged clamping action. The screen includes covers (54) which are configured to be clipped to the frame members (3) and which each have a second holding channel (60) formed therein. The screen further includes a sealing assembly comprising first sealing members (51) and second sealing members (61). The first sealing members (51) are supported by the first holding channel (50) in the frame members (3) and positioned against one side of the mesh (4) and the second sealing members (61) are supported by the second holding channel (60) in the covers (54) and positioned on another side of the mesh (4).

10 Claims, 5 Drawing Sheets

U.S. PATENT DOCUMENTS

| | | | | | |
|---|---|---|---|---|---|
| 2,283,574 | A | * | 5/1942 | Pillsbury | 160/380 |
| 2,335,361 | A | * | 11/1943 | Schiller | 160/395 |
| 2,791,004 | A | * | 5/1957 | Sullivan | 52/204.55 |
| 3,818,550 | A | * | 6/1974 | Cresswell | 24/461 |
| 4,189,880 | A | * | 2/1980 | Ballin | 52/202 |
| 4,232,310 | A | * | 11/1980 | Wilson | 340/550 |
| 4,399,640 | A | * | 8/1983 | Porter | 52/202 |
| 4,662,038 | A | * | 5/1987 | Walker | 24/460 |
| 4,899,797 | A | * | 2/1990 | Green | 160/395 |
| 4,947,561 | A | * | 8/1990 | Delacroix et al. | 38/102.91 |
| 4,991,640 | A | * | 2/1991 | Verkindt et al. | 160/368.1 |
| 5,398,388 | A | * | 3/1995 | Coleman | 24/593.11 |
| 5,467,546 | A | * | 11/1995 | Kovalak, Jr. | 40/603 |
| 5,647,155 | A | * | 7/1997 | Hillstrom | 40/603 |
| 5,953,873 | A | * | 9/1999 | Livingston et al. | 52/222 |
| 6,125,910 | A | * | 10/2000 | Pepperell et al. | 160/371 |
| 6,412,538 | B1 | * | 7/2002 | Welfonder | 160/271 |
| 6,802,357 | B2 | * | 10/2004 | Taylor et al. | 160/371 |
| 7,165,296 | B2 | * | 1/2007 | Coleman | 24/462 |
| 7,537,043 | B2 | * | 5/2009 | Veivers et al. | 160/380 |
| 7,712,268 | B1 | * | 5/2010 | Guthrie | 52/202 |
| 7,735,540 | B2 | * | 6/2010 | Armstrong | 160/328 |
| 7,740,048 | B2 | * | 6/2010 | Wilson | 160/371 |
| 2004/0244922 | A1 | * | 12/2004 | Colombi | 160/369 |

FOREIGN PATENT DOCUMENTS

| | | | | |
|---|---|---|---|---|
| AU | 2006235977 | B2 | | 7/2007 |
| WO | WO 2004057146 | A1 | * | 7/2004 |
| WO | WO 2006/063413 | A1 | | 6/2006 |
| WO | WO 2006063413 | A1 | * | 6/2006 |

* cited by examiner

CORROSION RESISTANT INTRUDER SCREEN

FIELD OF THE INVENTION

THIS INVENTION relates to a corrosion resistant intruder screen. In particular, it relates to a seal that prevents moisture from damaging the screen.

BACKGROUND OF THE INVENTION

Screens or grilles are sometimes used to improve the security of a building. For example, steel bar grilles have been used to deter intruders from entering a premises through a window or door. When used for a window the steel bar grilles are bolted to a wall surface adjacent the window. When used for a doorway the steel bar grilles are pivotally mounted to the doorway and operate as an extra door.

A far more effective intruder resistant screen has been described in our Australian Patent Number 694515. The intruder resistant screen referred to in this patent has been used commercially for many years, with much success.

However, while efficient at keeping out intruders it has since been found that over a period of time these screens are susceptible to corrosion due to penetration by moisture. The moisture seeps through a gap between the mesh screen and the frame.

The problem is that there can be a build up of salts from the moisture. The frame of the intruder resistant screen is made from aluminium, while the woven mesh is made from stainless steel. The electrochemical process that occurs when one type of metal is in contact with another type of metal, in the presence of an electrolyte, will result in corrosion of one or both of the metals.

A strip of plastic tape, such as electrical insulation tape, placed between the mesh and the frame can address the problem. However, the process of fixing the tape is cumbersome and requires precise application at the assembly stage. If the tape is not applied correctly, then parts of the aluminium frame will end up in contact with the stainless steel mesh. Any protection the tape might have given against corrosion will be lost.

This corrosion of the intruder resistant screen weakens the screen, which in turn weakens the security that the screen provides to its user.

SUMMARY OF THE INVENTION

It is an object of the invention to provide a corrosion resistant intruder screen which alleviates at least one of the problems associated with prior art security screening of doorways, windows or the like.

According to one aspect of the invention there is provided corrosion resistant intruder screen which comprises:

a frame comprising elongate frame members each having a first holding channel formed therein and a clamping portion spaced from the first holding channel;

a mesh covering an opening enclosed by the frame;

separately formed clamping members each co-acting with respective fastening means to thereby clamp the mesh between the clamping members and the clamping portions with leveraged clamping action;

covers which are each configured to be clipped to a frame member and which has a second holding channel formed therein; and a sealing assembly comprising:

first sealing members supported by the first holding channels and positioned against one side of the mesh; and second sealing members supported by the second holding channels and positioned against another side of the mesh.

Preferably, the clamping members have an extended lip for adding pressure to the covers and the covers have a retaining ledge positioned under the extended lip of the clamping member.

Preferably, each of the covers include a clip and the frame members each include a hooking member which the clips engage.

Preferably, the clamping portions have a serrated profile on a face adjacent the clamping members and the clamping members have a serrated profile on a face adjacent the clamping portion.

Preferably, the first sealing member and the second sealing member have a cap with bevelled edges, which is angled for maximum moisture runoff.

Preferably, the first sealing member and the second sealing member each have a ridged contact face which abuts against the mesh.

Preferably, the sealing assembly is made from a water resistant material, such as rubber, plastic or santoprene.

The sealing assembly may be reinforced using a sealant, such as glue or any other water proofing agent.

Preferably, the mesh has spacings between adjacent wefts and warps of no greater than 2.2 millimeters.

According to another aspect of the invention there is provided a frame for a corrosion resistant intruder screen, the frame including:

at least one elongate frame member having a first holding channel formed therein and a clamping portion spaced from the first holding channel;

at least one separately formed clamping member co-acting with fastening means to clamp a mesh between the clamping member and the clamping portion with leveraged clamping action;

at least one cover which is configured to be clipped to the frame member and which has a second holding channel formed therein; and a sealing assembly comprising:

a first sealing member supported by the first holding channel and positioned against one side of the mesh; and a second sealing member supported by the second holding channel and positioned against another side of the mesh.

BRIEF DESCRIPTION OF THE DRAWINGS

In order that the invention may be readily understood and put into practical effect, reference will now be made to preferred embodiments in which.

DETAILED DESCRIPTION

Figure 1:
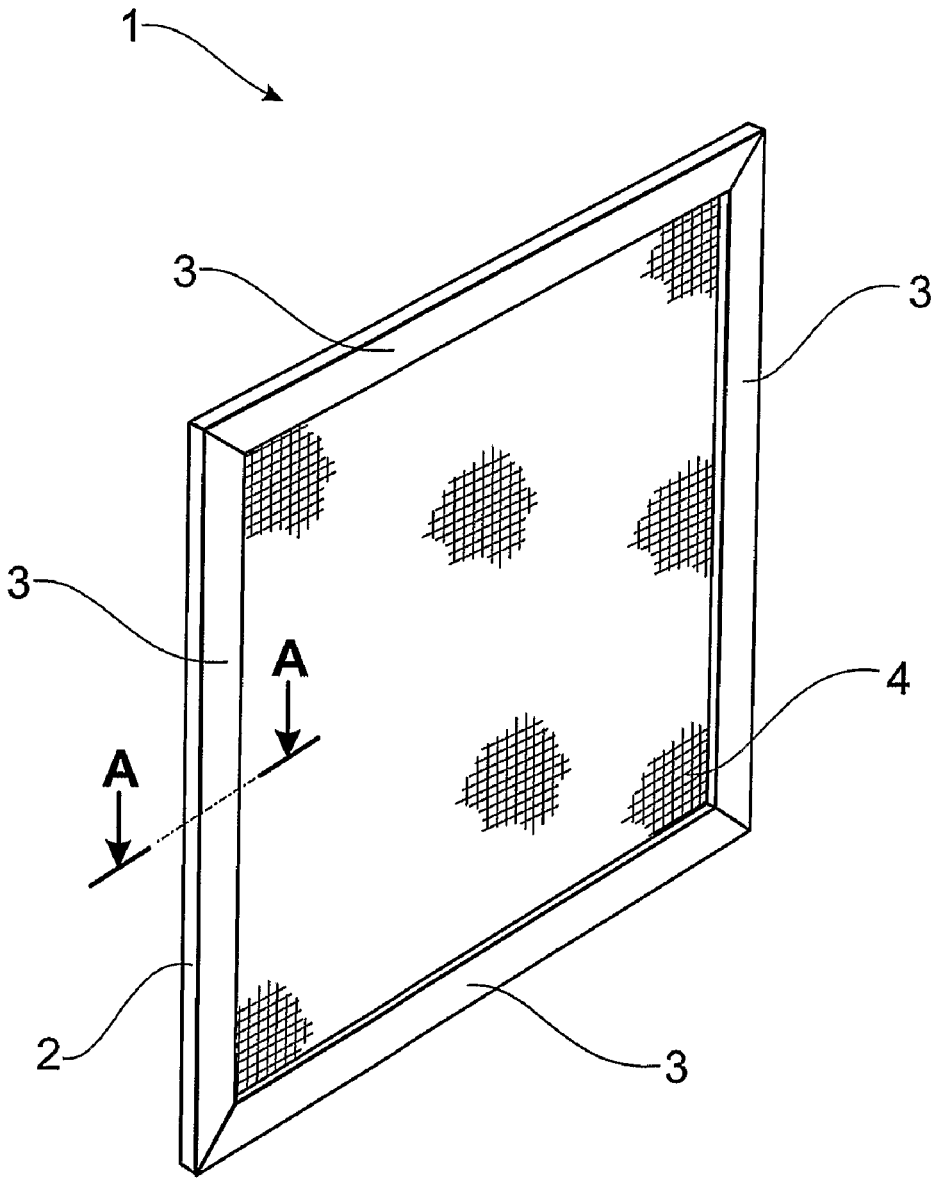
FIG. 1 is a perspective view of a corrosion resistant intruder screen.

With reference to FIG. 1 there is illustrated a corrosion resistant intruder screen 1 having a frame 2 comprised of elongate frame members 3 with a resistive mesh 4 clamped to frame members 3.

Mesh 4 covers the opening enclosed by frame 2. Mesh 4 is a woven grid of stainless steel wire. Suitable mesh dimensions have been described in Australian Patent 694515. The most suitable dimensions have been found to be wire diameters from 0.8 mm to 1.2 mm and wire spacing (in weft or warp) from 1 mm to 2.2 mm.

Figure 2:
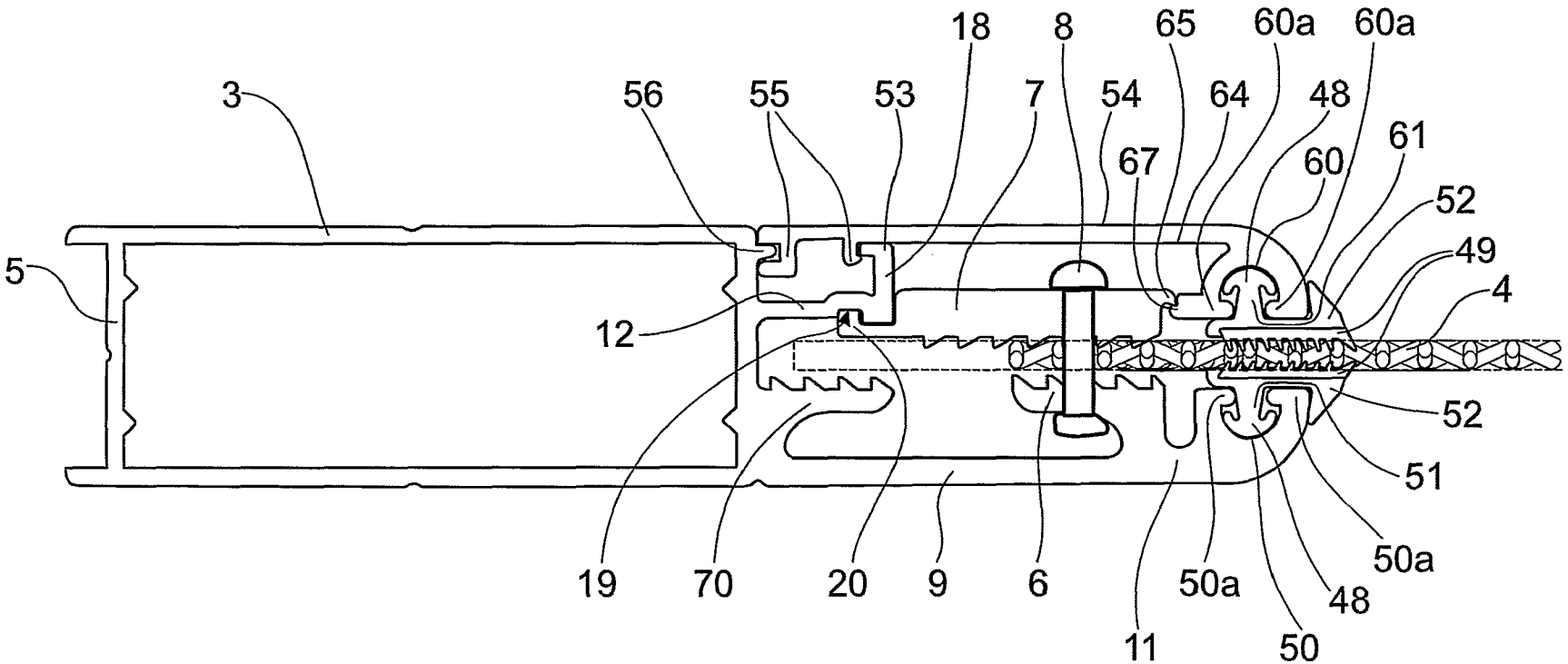
FIG. 2 is a cross sectional view through A-A of FIG. 1 illustrating an embodiment of the invention.
Figure 3:
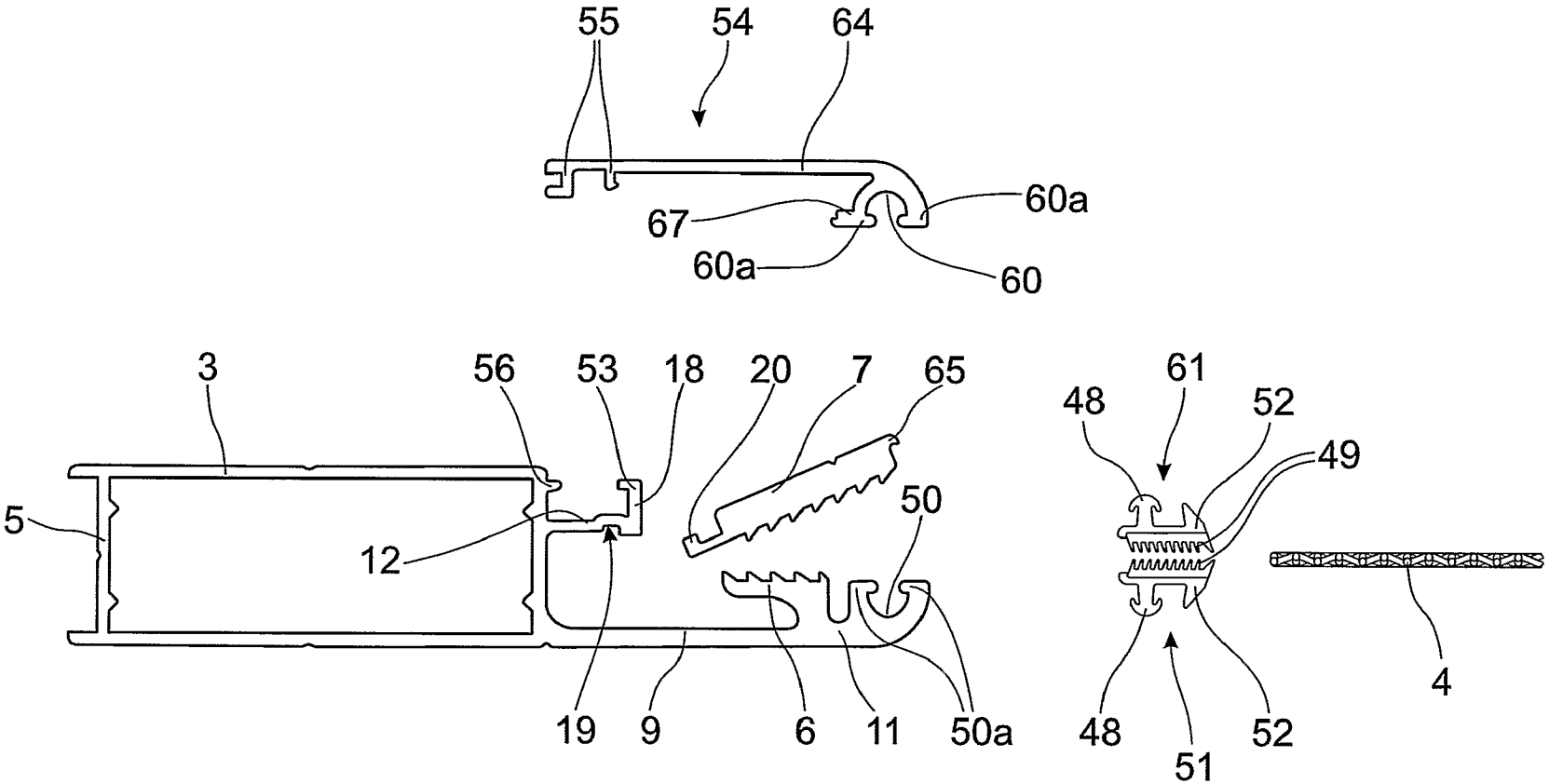
FIG. 3 is an exploded perspective view of the embodiment of FIG. 2.

Referring to FIG. 2 and FIG. 3, an embodiment of frame members 3 including a sealing assembly is illustrated. Frame member 3 is formed from extruded aluminium and has a channel section 5. Accordingly, frame 2 is formed to a desired shape and dimensions by cutting suitable lengths of each frame member 3 and assembling the lengths with mitred corners. Although frame members 3 are preferably extruded aluminium lengths, they may be extruded, roll formed or press formed lengths of any suitable material including plastics material.

An integral clamping portion 6 and a non-integral clamping member 7 are located inwardly of channel 5. The clamping portion 6 and the clamping member 7 extend along the length of frame member 3. Spaced holes are drilled along the clamping portions 6 and the clamping members 7 to receive fastening means 8, such as washer-head screws, or pop-rivets. The fastening means 8 add "pull down" strength, which co-acts with the clamping portion 6 and the clamping member 7 to clamp mesh 4 to frame 2. The clamping member 7 has been designed to remove the need for counter sinking. Counter sinking damages the aluminium thereby weakening the clamping member 7. By eliminating counter sunk holes the strength of the clamping member 7 has been increased.

When clamped, an area adjacent each respective edge of mesh 4 is clamped to frame 2 such that each clamped area is in the same plane as the rest of mesh 4 which is enclosed by frame 2.

An upper surface of the clamping portion 6 and an under surface of clamping member 7 may be serrated to provide stronger retention of the mesh 4. The serrations provide a significant advance over previous inventions by catching strands of the mesh to clamp the mesh 4 more effectively.

Extending inwardly from channel section 5 is a lip section 12. Lip section 12 terminates in hook 18. A slot 19 is formed in the underside of the lip section 12. Slot 19 accommodates an edge 20 of clamping member 7 to locate the clamping member 7 relative to the frame member 3. The lip section 12 enables leverage of the clamping member 7 so that it secures the mesh 4 more firmly against clamping portion 6.

To increase the strength of the clamping mechanism an extra clamp 70 may extend inwardly from the channel section 5. The upper surface of the extra clamp 70 may also be serrated to provide additional mesh retention. The added advantage of the extra clamp 70 is that the size of the mesh can be increased. This may be particularly useful for commercial application.

An integral wall section 9 extends inwardly from the channel section 5. Formed with the wall section 9 is a flange section 11 which extends towards mesh 4 and supports clamping portion 6.

Continuing outwardly from the flange section 11 is a first holding channel 50 defined by two first holding channel walls 50*a*. The first holding channel 50 extends along the length of frame member 3 and is designed to receive a plug 48 of a first sealing member 51, which is also the same length as the frame member 3.

The first sealing member 51 provides a moisture-tight seal between the first holding channel walls 50*a* and the mesh 4. The first sealing member 51 comprises a sealing member cap 52, the plug 48 and a ridged contact face 49. The sealing member cap 52 has a bevelled edge to promote water runoff. The plug 48 is dimensioned and configured to be received in the first holding channel 50. The ridged contact face 49 abuts against the mesh 4 to seal the gap between the mesh 4 and the frame member 3. The ridges of the contact face 49 provide enhanced sealing between the mesh 40 and the sealing members 51, 61.

A cover 54, comprising a cover wall 64 and a second holding channel 60 defined by two second holding channel walls 60*a* receives a second sealing member 61. The second holding channel walls 60*a* may extend downwardly from a distal end of the cover wall 64. The second sealing member 61, inserted into the second holding channel 60, provides a moisture-tight seal between the adjacent side of the mesh 4 to that of the first sealing member 51 and the frame 2. The second sealing member 61 has a sealing member cap 52, a plug 48 and a ridged contact face 49. The second sealing member 61 functions in the same way as the first sealing member 50. The sealing members 51, 61 are formed by co-extrusion, having a softer santoprene rubber for the ridged contact face 49 and a harder santoprene rubber for the plug 48 and part of the sealing member cap 52.

The first sealing member 51 and second sealing member 61 are aligned to provide maximum moisture-tight sealing, with the cover 54 providing the pressure needed for such a seal. It should be appreciated that a sealant such as glue or any other water-proofing agent can be used in conjunction with the first sealing member 51 and the second sealing member 61 for added strength and moisture protection. It should be appreciated that the first sealing member 51 and second sealing member 61 can be made from waterproof material, such as santoprene, rubber or plastic.

From lip section 12 extends upwardly a hooking member 53. Furthermore, from channel section 5 protrudes a ledge 56. The hooking member 53 and the ledge 56 are designed to receive a clip 55 which extends downwardly from the cover 54. The clip 55 is located at the opposite end of the cover 54 to that of the second holding channel 60.

A retaining ledge 67, located on the innermost second holding channel wall 60*a*, clips under an extended lip 65 located on clamping member 7. The extended lip 65 adds additional pressure to the cover 54 for a tighter moisture seal and strengthened impact resistance.

Referring to FIG. 3, the sealing assembly can be assembled by inserting the first sealing member 51 into the first holding channel 50 so that the first sealing member 51 extends along the length of the first holding channel 50. The mesh 4 is then placed over the first sealing member 51 and the clamping portion 6 and if necessary over the extra clamp 70. The mesh 4 should be positioned so that the serrations on clamping portion 6 and extra clamp 70 can provide maximum retention.

Once the mesh 4 is in the desired position, clamping member 7 is then placed over the mesh 4 and secured to the sealing assembly. The edge 20 at one end of the clamping member 7 is received by slot 19, while the other end is aligned with clamping portion 6. Clamping member 7 should be positioned for maximum mesh retention. Clamping member 7 and clamping portion 6 are then secured using fastening means 8. If required, extra fastening means 8*a* may be added to secure the mesh 4 between the extra clamp 70 and lip section 12.

The second sealing member 61 is inserted into the second holding channel 60 so that it extends along the length of the second holding channel 60. It should be noted that the second sealing member 61 may be installed at the same stage that the first sealing member 51 is installed.

The final step in assembling the sealing assembly is to attach the cover 54. The cover 54 is secured by latching the clip 55 onto the hooking member 53 and the ledge 56. In latching the cover 54 it is important that the retaining ledge 67 of the innermost second holding channel wall 60*a* is positioned under the extended lip 65 of clamping member 7. This is to ensure that the sealing assembly is tightly sealed and adds strength for impact resistance.

Once the cover 54 is in place, it provides added strength to the frame member 3 as well as added protection against moisture. The cover 54 also aids in the aesthetics of the corrosion intruder resistant screen 1 by hiding fasteners 8.

Figure 4:
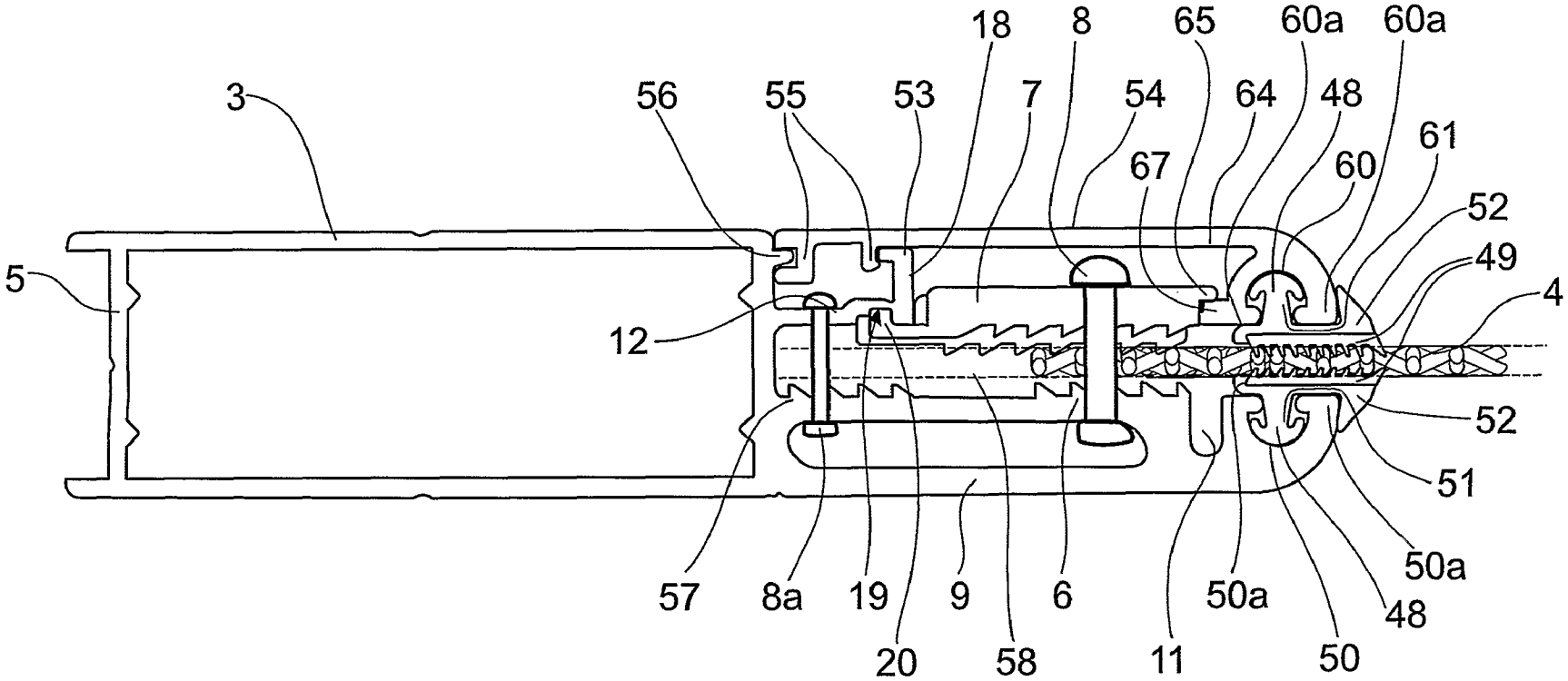
FIG. 4 is a cross sectional view similar to FIG. 2 illustrating a second embodiment of the invention.

Illustrated in FIG. 4 is a second embodiment similar to the embodiment as shown in FIG. 2, but with a clamping wall 57 extending inwardly from channel section 5 and forming part of the clamping portion 6. The clamping wall 57 provides additional support to the clamping portion 6 and forms a retainer area 58, which aids in strengthening the mesh-clamping system.

Extra fastening means 8*a* may be added to further secure the mesh 4 between the lip section 12, integral with and extending inwardly from channel section 5 and the extra clamp 70.

The clamping wall 57 may also be serrated to increase mesh 4 retention, though this need not be the case in all circumstances.

Figure 5:
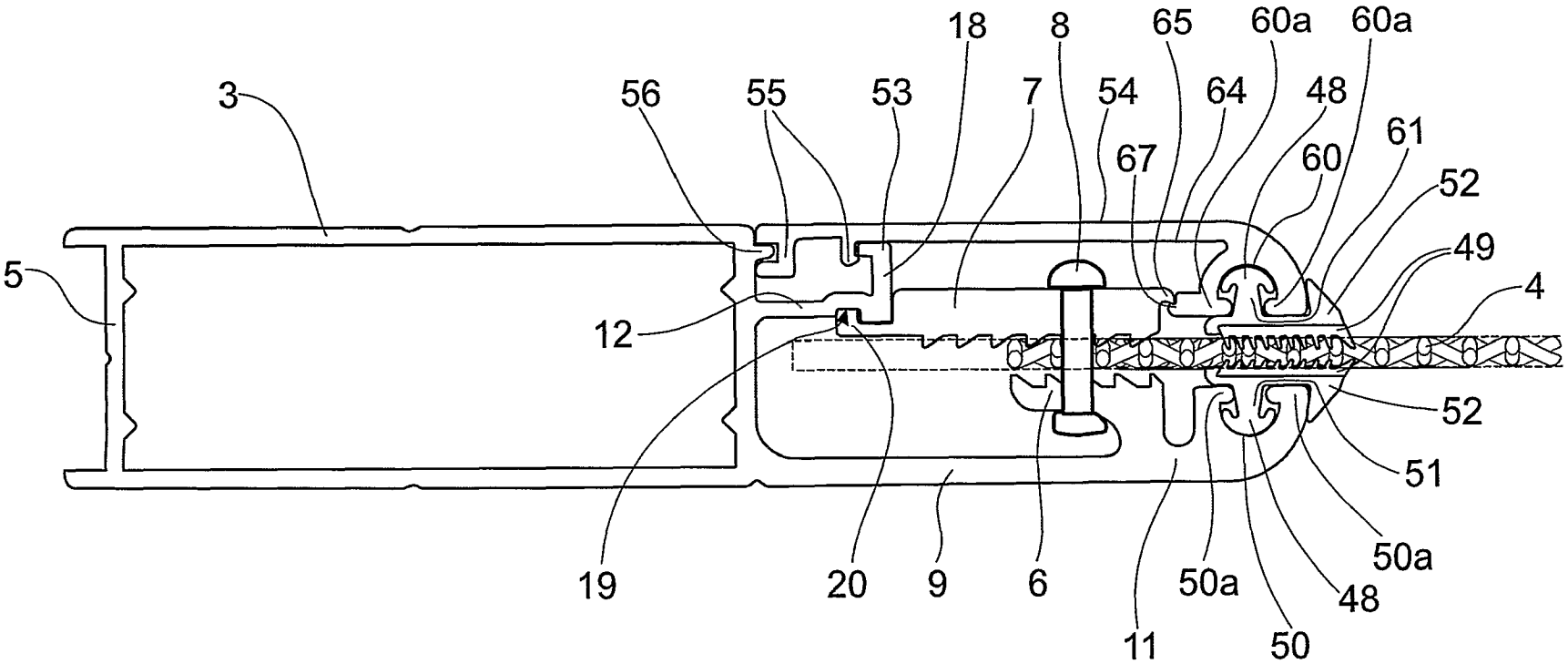
FIG. 5 is a cross sectional view similar to FIG. 2 illustrating a third embodiment of the invention.

A third embodiment, illustrated in FIG. 5, shows a frame member 3 similar to that of FIG. 2, but with the omission of an extra clamp 70. The remaining features are as described above. This design may be a lower cost alternative for use in a domestic environment.

The inclusion of a sealing assembly, such as that of the first sealing member 51 and second sealing member 61, gives the frame member 3 an advantage over previous designs in that it is an effective and inexpensive way to prevent the intrusion of moisture through the gap between the frame 2 and the mesh 4, thereby preventing corrosion. The sealing means is easy to install, unlike methods that may use tape, and increases the useful life of an intruder resistant screen.

Due to the increased strength provided by the cover 54 and the extra clamp 70, the corrosion resistant intruder screen 1 can be applicable for both commercial and domestic use.

The construction of the frame members 3 to form the frame 2 is as described in our previous patent.

Although the invention has been described with reference to preferred embodiments, it is to be understood that the invention is not limited to the specific embodiments described herein.

The invention claimed is:

1. A corrosion resistant intruder screen which comprises:

a frame comprising elongate frame members each having a first holding channel formed therein and a clamping portion, spaced from the first holding channel, positioned against one side of a mesh;

the mesh covering an opening enclosed by the frame; separately formed clamping members each positioned against another side of the mesh and co-acting with respective fastening means to thereby clamp the mesh between the clamping members and the clamping portions with leveraged clamping action;

covers which are each configured to be clipped to a frame member and which have a second holding channel formed therein; and a sealing assembly comprising:

first sealing members supported by the first holding channels and positioned against the one side of the mesh; and second sealing members supported by the second holding channels and positioned against the another side of the mesh.

2. The corrosion resistant intruder screen of claim 1, wherein the clamping members have an extended lip for adding pressure to the covers and the covers have a retaining ledge positioned under the extended lip of the clamping member.

3. The corrosion resistant intruder screen of claim 1, wherein each cover includes a clip and the frame members each include a hooking member which the clips engage.

4. The corrosion resistant intruder screen of claim 1, wherein the clamping portions have a serrated profile on a face adjacent the clamping members and the clamping members have a serrated profile on a face adjacent the clamping portion.

5. The corrosion resistant intruder screen of claim 1, wherein the first sealing member and the second sealing member have a cap with bevelled edges, which is angled for maximum moisture runoff.

6. The corrosion resistant intruder screen of claim 1, wherein the first sealing member and the second sealing member each have a ridged contact face which abuts against the mesh.

7. The corrosion resistant intruder screen of claim 1, wherein the sealing assembly is made from a water resistant material.

8. The corrosion resistant intruder screen of claim 1, wherein the sealing assembly is reinforced using a sealant.

9. The corrosion resistant intruder screen of claim 1, with the mesh having spacings between adjacent wefts and warps of no greater than 2.2 millimeters.

10. A frame for a corrosion resistant intruder screen, the frame including:

at least one elongate frame member having a first holding channel formed therein and a clamping portion positioned against one side of a mesh and spaced from the first holding channel;

at least one separately formed clamping member positioned against another side of the mesh and co-acting with fastening means to clamp a mesh between the clamping member and the clamping portion with leveraged clamping action;

at least one cover which is configured to be clipped to the frame member and which has a second holding channel formed therein; and a sealing assembly comprising:

a first sealing member supported by the first holding channel and positioned against the one side of the mesh; and a second sealing member supported by the second holding channel and positioned against the another side of the mesh.

* * * * *

UNITED STATES PATENT AND TRADEMARK OFFICE

CERTIFICATE OF CORRECTION

PATENT NO. : 8,347,939 B2
APPLICATION NO. : 13/001607
DATED : January 8, 2013
INVENTOR(S) : Brabeck et al.

It is certified that error appears in the above-identified patent and that said Letters Patent is hereby corrected as shown below:

On the title page item (73) should read --IPH International Pty Ltd.--

Signed and Sealed this
Twenty-eighth Day of January, 2014

Michelle K. Lee

Michelle K. Lee
*Deputy Director of the United States Patent and Trademark Office*